US010888757B2

(12) United States Patent
Feeney

(10) Patent No.: US 10,888,757 B2
(45) Date of Patent: Jan. 12, 2021

(54) SPORTS EQUIPMENT

(71) Applicant: Stephen Patrick Feeney, Norwich (GB)

(72) Inventor: Stephen Patrick Feeney, Norwich (GB)

( * ) Notice: Subject to any disclaimer, the term of this patent is extended or adjusted under 35 U.S.C. 154(b) by 0 days.

(21) Appl. No.: 14/897,988

(22) PCT Filed: Jun. 24, 2014

(86) PCT No.: PCT/GB2014/051919
§ 371 (c)(1),
(2) Date: Dec. 11, 2015

(87) PCT Pub. No.: WO2014/207444
PCT Pub. Date: Dec. 31, 2014

(65) Prior Publication Data

US 2016/0144254 A1 May 26, 2016

(30) Foreign Application Priority Data

Jun. 25, 2013 (GB) ..... 1311263.6

(51) Int. Cl.

| | |
|---|---|
| ***A63D 15/00*** | (2006.01) |
| ***A63D 15/08*** | (2006.01) |
| ***A63B 53/04*** | (2015.01) |
| ***A63B 69/36*** | (2006.01) |

(Continued)

(52) U.S. Cl.

CPC ..... *A63B 69/00* (2013.01); *A63B 53/04* (2013.01); *A63B 53/0487* (2013.01); *A63B 69/36* (2013.01); *A63B 69/3685* (2013.01); *A63D 15/08* (2013.01); *A63B 53/047* (2013.01); *A63B 53/0466* (2013.01); *A63B 2053/0441* (2013.01);

(Continued)

(58) Field of Classification Search

CPC ..... A63B 69/3676; A63B 69/3632; A63B 53/0487; A63B 69/00; A63B 53/04; A63B 69/36; A63B 69/3685; A63B 53/0466; A63B 53/047; A63B 2053/0441; A63B 2071/0694; A63D 15/08

USPC .... 473/2, 4, 5, 44, 241, 242, 231, 254, 253, 473/252

See application file for complete search history.

(56) References Cited

U.S. PATENT DOCUMENTS 1,433,150 A * 10/1922 Reach ..... A63B 53/0487 473/251
3,019,022 A * 1/1962 Ehmke ..... A63B 69/3685 473/240

(Continued)

FOREIGN PATENT DOCUMENTS

CN 201799090 U 4/2011
GB 399087 9/1933

(Continued)

OTHER PUBLICATIONS

Search Report dated Dec. 17, 2013 out of corresponding Great Britain priority Application No. 1311263.6 (6 pages).

(Continued)

*Primary Examiner* — Mitra Aryanpour
(74) *Attorney, Agent, or Firm* — Patterson Thuente Pedersen P. A.

(57) ABSTRACT

A cue or golf club head having a sighting aid, a golf club having the golf club head, and uses thereof.

21 Claims, 3 Drawing Sheets

(51) Int. Cl.
*A63B 69/00* (2006.01)
*A63B 71/06* (2006.01)

(52) U.S. Cl.
CPC . *A63B 2071/0694* (2013.01); *A63B 2243/002* (2013.01)

(56) References Cited

U.S. PATENT DOCUMENTS 3,389,911 A * 6/1968 Castiglione, Jr. .... A63D 15/006 473/2
3,430,963 A * 3/1969 Wozniak ..... A63B 53/007 473/251
3,880,430 A 4/1975 McCabe
4,136,877 A * 1/1979 Antonious ..... A63B 53/0487 473/254
4,458,900 A * 7/1984 Antonious ..... A63B 53/0487 473/254
4,527,799 A * 7/1985 Solheim ..... A63B 69/3685 473/253
4,629,193 A * 12/1986 Pierman ..... A63B 69/3685 473/254
4,650,191 A * 3/1987 Mills ..... A63B 69/3632 473/341
4,688,799 A * 8/1987 Johnson ..... A63B 53/04 473/230
4,693,478 A * 9/1987 Long ..... A63B 53/0487 473/251
4,722,528 A * 2/1988 Tsao ..... A63B 53/0487 473/254
4,741,535 A * 5/1988 Leonhardt ..... A63B 53/0487 473/252
4,809,981 A * 3/1989 Doran ..... A63B 69/3685 473/249
4,921,253 A * 5/1990 Tesori ..... A63B 53/0487 473/341
4,960,279 A * 10/1990 Harris, Jr. ..... A63B 53/0487 473/251
4,962,931 A 10/1990 Jazdzyk, Jr.
4,986,544 A * 1/1991 Benson ..... A63B 53/0487 473/254
4,988,107 A * 1/1991 Sasse ..... A63B 69/3685 473/254
5,558,584 A * 9/1996 Brown ..... A63D 15/08 473/44
5,676,603 A * 10/1997 Miller ..... A63B 69/3614 473/220
5,704,842 A * 1/1998 Petrusek ..... A63D 15/08 473/44
5,720,668 A * 2/1998 Brett ..... A63B 69/3685 473/242
5,800,279 A * 9/1998 Densberger ..... A63B 53/0487 473/220
6,200,227 B1 3/2001 Sery
RE37,519 E * 1/2002 Densberger ..... A63B 53/0487 473/240
7,182,697 B2 * 2/2007 Zamora ..... A63B 53/0487 473/251
7,766,762 B2 * 8/2010 Stellander ..... A63B 53/0487 473/251
9,044,666 B2 * 6/2015 Cameron ..... A63D 15/105 473/2
2002/0098908 A1 * 7/2002 James ..... A63B 53/0487 473/324
2003/0186756 A1 * 10/2003 Baron ..... A63B 53/0487 473/252
2006/0030418 A1 * 2/2006 Evans ..... A63D 15/08 473/44
2007/0135232 A1 * 6/2007 Billings ..... A63B 53/0487 473/340
2008/0220887 A1 * 9/2008 Evans ..... A63D 15/08 473/44
2009/0017933 A1 1/2009 Stites et al.
2016/0144254 A1 * 5/2016 Feeney ..... A63B 69/3685 473/2

FOREIGN PATENT DOCUMENTS

GB 1 565 725 4/1980
GB 2 149 670 6/1985
GB 2149670 A * 6/1985 ..... A63B 69/3632
GB 2 219 517 12/1989
GB 2 319 968 6/1998
GB 2515652 A * 12/2014 ..... A63B 69/3685
WO WO 01/17621 3/2001

OTHER PUBLICATIONS

Search Report dated Aug. 1, 2014 out of corresponding Great Britain priority Application No. 1311263.6 (5 pages).
International Search Report dated Sep. 22, 2014 out of corresponding priority Application No. PCT/GB2014/051919 (5 pages).
Written Opinion of the International Searching Authority dated Sep. 22, 2014 out of corresponding priority Application No. PCT/GB2014/051919 (7 pages).
Amendment dated Sep. 5, 2019 for EP Application No. EP14736426.9, 7 pages.
Office Action dated Mar. 29, 2018 for Chinese Application No. 201480035651.2, 10 pages.
Office Action dated Mar. 6, 2019 for EP Application No. 14736426.9, 7 pages.

* cited by examiner

SPORTS EQUIPMENT

This application claims priority to International Application No. PCT/GB2014/051919 filed Jun. 24, 2014, which claims priority to GB Patent Application No. 1311263.6 filed Jun. 25, 2013; the entire contents of each are incorporated herein by reference.

FIELD OF THE INVENTION

The invention relates to improved sports equipment, more particularly to an improved snooker cue and an improved golf club head (and golf club incorporating that head), together with uses thereof.

BACKGROUND TO THE INVENTION

Certain sports require an individual to be able to sight a straight line with high precision and to have the discipline and ability to do this consistently, particularly in targeting sports such as snooker, golf, bowls, darts and archery.

From the initial sighting, and when ready to play, or actually playing, the shot or stroke, one fundamental and commonly experienced problem is parallax error where the player sights across or parallel to the correct line of play. A common cause of the problem is eye dominance where one eye has an excessive influence in perceiving positions. Furthermore the level of this eye dominance may change over time. Parallax error may also be induced or compounded by bad stance, incorrect technique development, lack of awareness and/or discipline, bad compensating habits, or as a result of poor coaching practices.

Self evidently no coach or other person is able to see through the eyes of a player and, therefore, it is virtually impossible for a coach to diagnose parallax error effectively and advise on correction of it. The problem is, however, extremely important and significantly limits an individual's ability to improve his/her playing ability and fulfil his/her potential.

UK patent GB2319968 describes a sighting aid suitable for use in targeting sports such as, for example, snooker, golf (putting especially), bowls, darts or archery. The described sighting aid is a stand-alone device (portable or fixed installation), in the form of e.g. a rigid board (suitably of wood) for use in a coaching or training environment. For example, for golf coaching, the aid could be adapted for use as a playing surface from which the ball or other projectile to be aimed is launched (e.g. a board preferably at least a meter in length and at least 30 centimeters in width, preferably with an artificial putting green overlay material). For use as a snooker or pool sighting aid the upper surface of the board would suitably be overlaid with baize or similar material. The stand-alone sighting aid allows a user not only to perceive sighting parallax error offset but also to initiate practicing of shots/strokes to enable development of appropriate muscle memory to automatically compensate for inherent parallax error.

However, the sighting aid is of limited or no use to a user when not in a training or coaching environment i.e. in 'real-time' when playing a game of snooker or a round of golf. It is amongst the objects of the present invention to devise a solution to this problem.

SUMMARY OF THE INVENTION

Accordingly, the inventor provides a snooker cue or golf club head comprising a sighting aid, said sighting aid comprising a sighting body having marked or formed thereon a straight sighting line extending longitudinally thereof, which line is intercepted part way along its length by an up-step or down-step, wherein said sighting line runs parallel to the length of the snooker cue or to the face of the golf club head and is visible to the user in use.

In preferred embodiments the sighting line extends for the majority or the entirety of length of the sighting body and/or the sighting aid and/or is intercepted part way along its length by a down-step.

In preferred embodiments of the golf club head the sighting line is located substantially in-line with the face of the head.

The inventor also provides a golf club comprising a golf club head as described above, the use of a snooker cue as described above to sight a shot or stroke in a cue sport, and the use of a golf club head/golf club as described above to prepare for a shot in golf.

Included within the scope of the invention is a snooker cue, golf club or golf club head or use thereof substantially as described herein with reference to and as illustrated by any appropriate combination of the accompanying drawings.

BRIEF DESCRIPTION OF THE DRAWINGS

The invention will be described with reference to the accompanying drawings, in which.

DETAILED DESCRIPTION OF THE INVENTION

Figure 1:
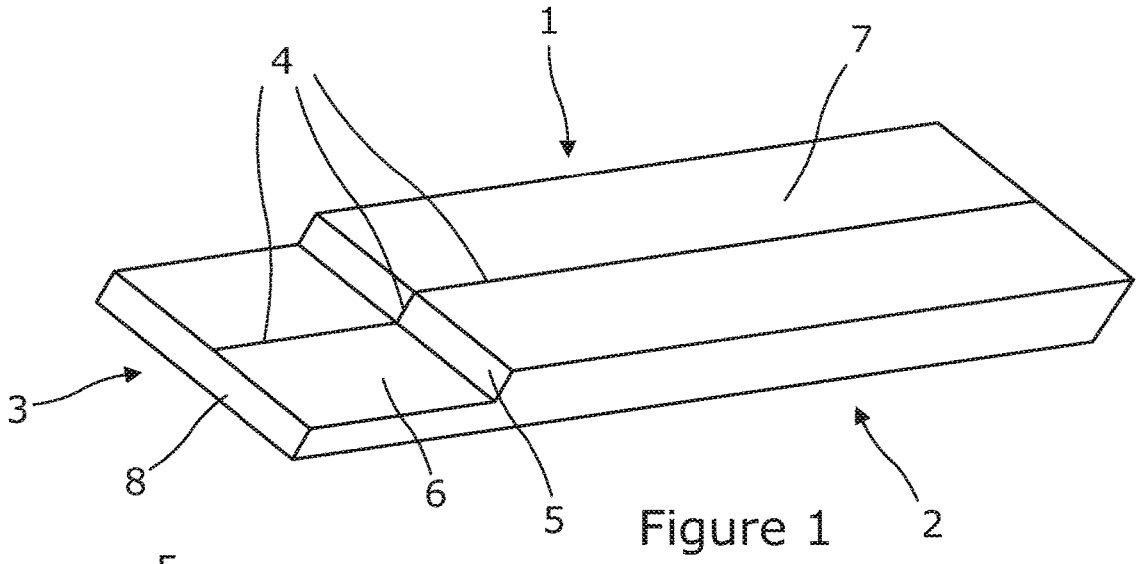
FIG. 1 is a perspective view of a sighting aid as viewed from the target-ward end.
Figure 2:
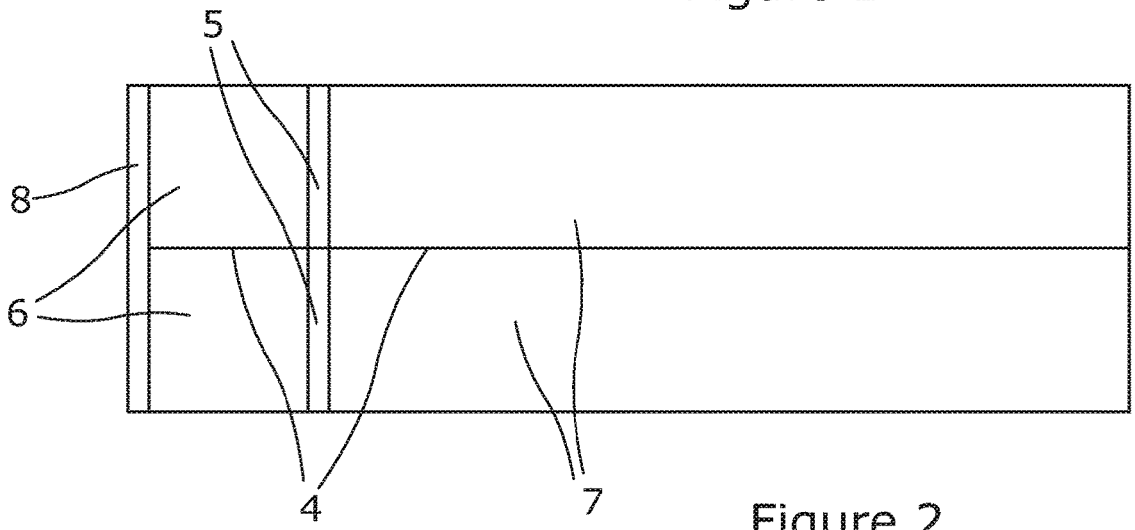
FIG. 2 is a plan view from above of a sighting aid.
Figure 3:
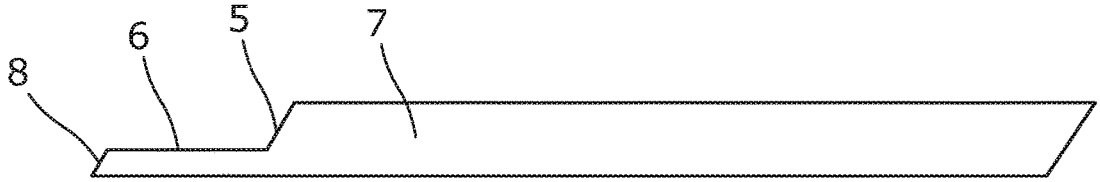
FIG. 3 is a side elevation view of a sighting aid.
Figure 4:
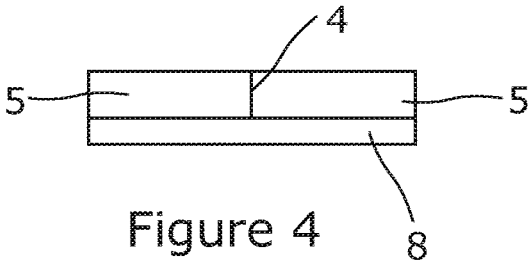
FIG. 4 is an end elevation view of the target-ward end of a sighting aid.

The inventor provides a snooker cue or golf club head comprising a sighting aid, said sighting aid comprising a sighting body having marked or formed thereon a straight sighting line extending longitudinally thereof, which line is intercepted part way along its length by an up-step or (preferably) down-step, wherein said sighting line runs (substantially or exactly) parallel to the length of the snooker cue or to the face of the golf club head and is visible to the user in use. Note that the sighting line does not need to be marked or formed on the up-step or down-step itself.

A snooker cue includes any cue suitable for use in play of a cue sport e.g. snooker, pool or billiards and the term generally refers to an elongate and substantially tubular device whose diameter is greater towards a handle end and smaller towards the opposite, ball-striking end. A golf club head includes any head part that can attach to a shaft to form a golf club, and includes a 'Wood', 'Iron' or, preferably, a 'Putter' head. The sighting aid/body may be a discrete and either permanently or releasably attached part of the cue/head or it may be integrated within the cue/head. For instance, the sighting body may simply be a particular area of the cue or club head. Releasable attachment means include e.g. magnetic or mechanical means (e.g. straps or clips).

Referring to FIGS. 1 to 4, a sighting aid of the sort to be used in the present invention comprises a body such as an elongate board (1) having a first major portion (7) extending for the majority of length of the sighting aid and being of a substantially uniform thickness (e.g. in the order of 0.1-5 cm).

The target-ward end (8) of the sighting aid is a relatively thinner minor portion (6) of the board (1) and may suitably be, for example, less than half the thickness of the major portion (7) of the board and down-stepped (5) by that difference relative to the major portion (7). By this means a discontinuity in plane is formed between the upper surface of the major portion of the board and the upper surface of the minor portion. This vertical differential between the two surfaces provides the means for visualisation of any parallax error. Note that the step needn't be exactly vertical.

A sighting line (4) is marked or otherwise formed on the sighting aid extending along the length of the board (1) and cutting straight across the line of plane discontinuity which latter is preferably substantially perpendicular to the sighting line.

Note that in stand-alone use of such a sighting aid the objective is to obtain a stance in which the sighting line (4) is not disrupted at the point of planar discontinuity. Where parallax error is present the portion of sighting line on the minor, target-ward, portion (6) of the sighting aid will be laterally offset relative to the portion of the sighting line (4) on the major portion (7) of the sighting aid. The user should then make adjustments to compensate for this off-set so that it is no longer apparent.

Although the sighting line (4) is shown as extending continuously for the full length of the sighting aid this is not absolutely necessary since the line may be replaced by a short marking simply traversing the line of plane discontinuity (down-step (5)) sufficient only to enable any offset to be perceived and compensated for. Furthermore, although illustrated as being of substantially uniform thickness in the respective major (7) and minor (6) portions this is not absolutely necessary since the principle relies centrally upon vertical difference along the line of sight. Accordingly, the major portion (7) may, for example, be sloped upwardly to the discontinuity line and the discontinuity may comprise an up-step, not a down-step (5), to reach the target-ward end of the sighting aid.

The sighting aid/body used in the present invention is preferably elongate and the sighting aid, body and/or line is preferably no more than 50 cm in length, preferably no more than 30 cm in length, most preferably no more than 10 cm in length. The up-step or down-step is suitably at least 0.1 cm in height, such as at least 0.5 cm or 1 cm in height, and preferably no more than 10 cm in height (more preferably no more than 5 cm in height). Preferably, the sighting line extends at least 1 cm, and preferably at least 3 cm, before and/or beyond the up-step or down-step. Preferably the sighting line is at least 1 mm wide, preferably no more than 2 cm wide.

The Snooker Cue

Figure 5:
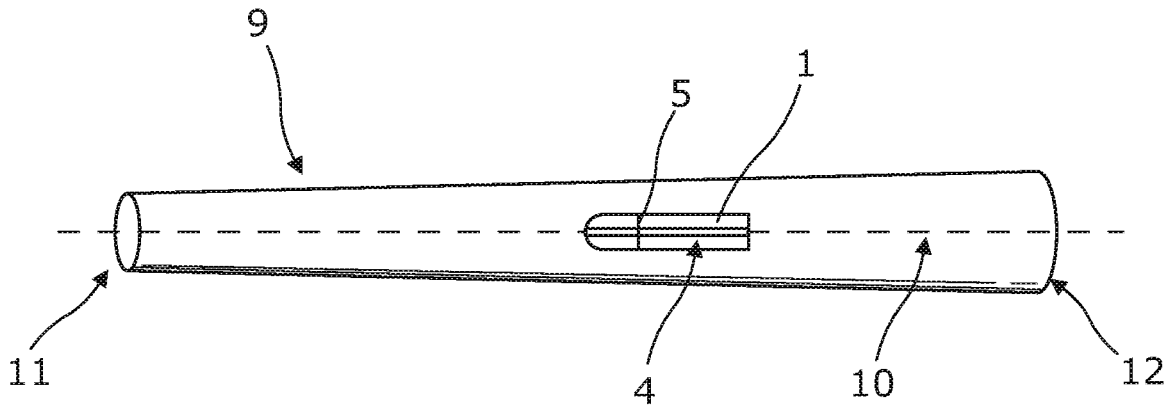
FIG. 5 is a plan view of an embodiment of the snooker cue of the invention.
Figure 6:
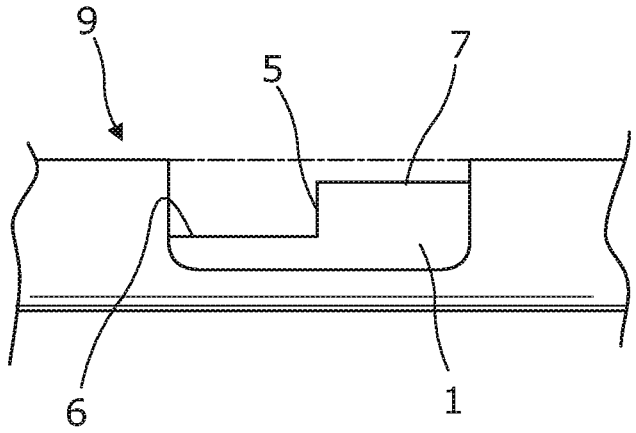
FIGS. 6 and 7 respectively show side elevation and perspective views of the same cue.
Figure 7:
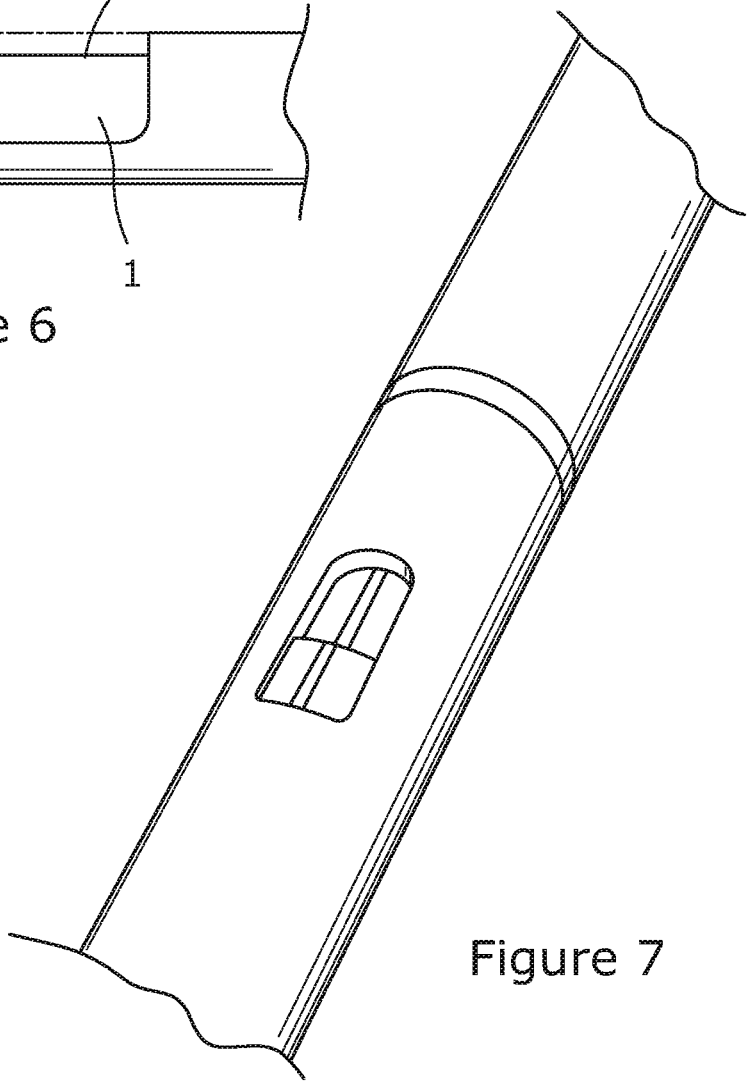

FIG. 5 shows a plan view of an embodiment of the snooker cue system of the invention (9) that includes a cue and a sighting aid, wherein the sighting line (4) runs parallel to the length of the cue, as defined here for example by a line (10) extending from the centre of its tip (ball-striking end) (11) to the centre of its base (handle end) (12). FIG. 6 shows a side elevation view of the same cue system, wherein the sighting body/line is sunk into the profile of the cue yet remains visible to the user in use (as it would with any positioning on a surface of the length of the cue, sunken or otherwise). Thus, the sighting aid does not extend past the exterior surface of the cue as shown in FIG. 6. FIG. 7 shows a perspective view of the cue system, with offline sighting by the user. Note that in another embodiment only the minor portion (6) of the sighting aid is sunk into the profile of the cue, wherein the plane of major portion (7) is e.g. in-line with the profile of the cue.

The sighting aid/body is shown as a discrete part that can be permanently or releasably attached to a recess within the cue. Note however that the embodied cue could be formed simply by sculpting/marking a conventional cue (in which case the sighting body becomes merely a particular area of the cue). Note also that the sighting aid/body/line is preferably located within the middle third of the cue length.

The inventor provides the use of a snooker cue according to the invention to sight (or 'aim') a shot or stroke in a cue sport, such as snooker, pool or billiards (said shot/stroke preferably to be played with the said same cue). The user can sight the shot/stroke using the cue of the invention, by viewing its sighting line, before, during and/or after taking their playing stance. In such a way the cue of the invention enables a user to sight a shot (and e.g. correct or exclude any parallax error) in real time i.e. whilst preparing for and/or playing a shot in a game of snooker. In such use e.g. the user aligns the cue with the direction of the target from the user, views the sighting line while attempting to sight the target, and determines from any off-set of the portion of the sighting line before the step relative to the portion of that sighting line after step whether and to what extent the attempt of the user to sight the target is in error. The user can then adjust the cue alignment to remove any error (i.e. until no off-set is seen), or maintain the cue alignment to exclude error, as the case may be.

The Golf Club

Figure 8:
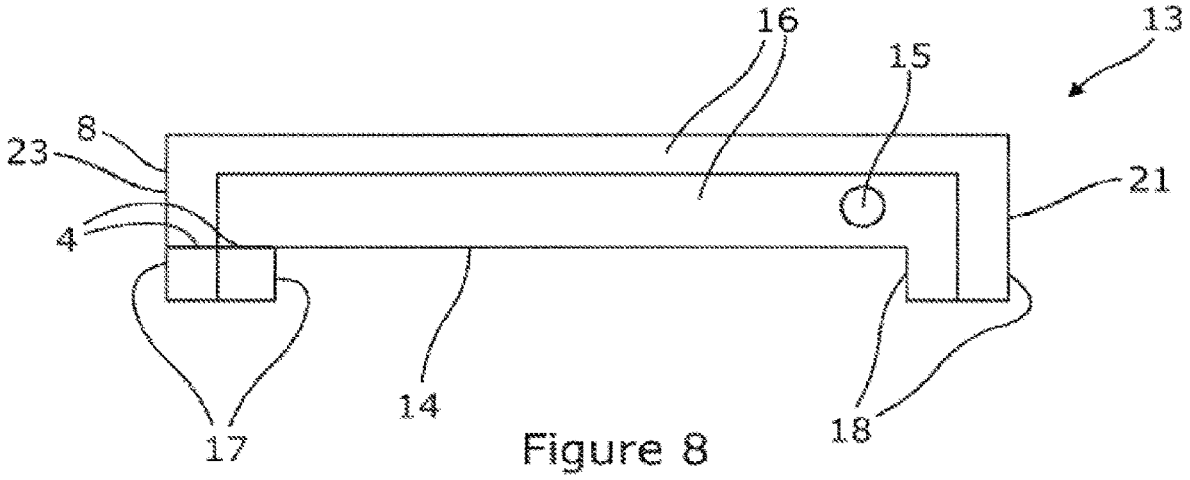
FIG. 8 is a plan view of an embodiment of the golf club head of the invention.
Figure 9:
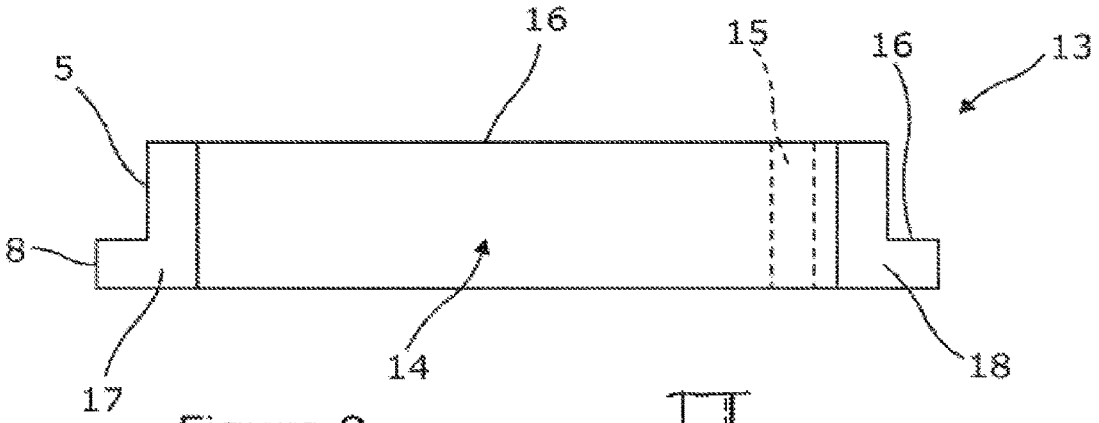
FIGS. 9 and 10 respectively show front elevation and perspective views of the same club head.
Figure 10:
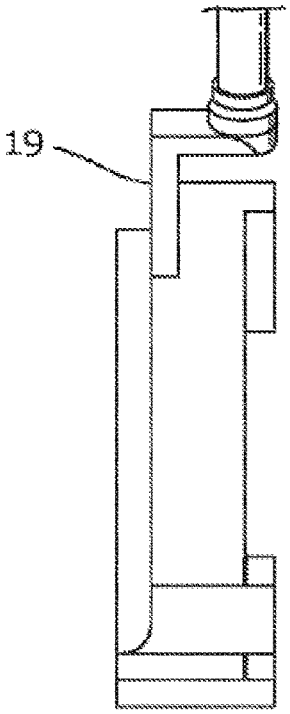

FIGS. 8 and 9 show plan and front elevation views (respectively) of an embodiment of the golf club head system of the invention, a putter head (13), wherein the sighting line (4) runs parallel to and specifically in-line with the face (14) of the putter head, wherein it is well known in the art that faces of putters and other golf clubs are structured to strike a golf ball during normal play. (15) marks the location of the attachment point for an L-shaped connector (19) that is attached to the bottom of the shaft of a club as shown in FIGS. 8 and 10. As shown in FIGS. 8 and 10, the shaft of the golf club substantially extends toward the sighting line (4). To be visible in use the sighting line will usually need to be on the 'top' (in use) surface (16) of the putter head (rather than the face, back or base of the club head). The sighting line is shown at the toe (23) of the putter head (as is preferred), rather than e.g. at the heel (21). Here, the target-ward end (8) of the sighting aid faces away from the user in use (and on a line that is perpendicular to the target once the club face has been correctly aligned). To position the sighting line (4) in-line with the putter face, a stepped protrusion (17) is formed at the toe (23) (wherein the protrusion protrudes away from the putter face, towards the direction in which a golf ball is to be played). A similar stepped protrusion (18) is (as preferred) placed at the heel (21) to balance the club head. FIG. 10 shows a side perspective view of the putter head, with sighting lines joined, indicating a square putter face. Also shown is a club shaft attached to the putter head.

The inventor provides the use of a golf club head or golf club according to the invention to prepare for a shot in golf (said shot preferably to be played with the said same golf club/head). In particular, said preparation is to ensure that the face of the club head is held at a perpendicular angle to the line in which the shot is to be played (e.g. line to target). The user can 'square-up' the club head face using the club/head of the invention, by viewing its sighting line, before, during and/or after taking their playing stance. In such a way the club/head of the invention enables a user to correctly align a shot (and e.g. correct parallax error) in real time i.e. immediately prior to playing a shot in a game of golf. The correction of parallax error (offset) is substantially as described above. Note that by using the club/head of the invention to 'square-up' the club head the user is also, and simultaneously, able to ensure a correct ball position in stance (e.g. a ball position on the user's line of sight).

The invention claimed is:

1. A cue system for enabling a user to sight a shot in real time while preparing for and making a shot, comprising:

a cue presenting a cue profile; and a sighting aid comprising a sighting body that includes a major portion and a minor portion, the sighting body having marked or formed thereon a straight sighting line extending longitudinally thereof, wherein the straight sighting line is intercepted by a sighting aid up-step or down-step presenting a vertical discontinuity along said sighting line in a plane formed between an upper surface of the major portion and an upper surface of the minor portion, said vertical discontinuity enabling visualization of parallax error, wherein the sighting aid is integral with or attached to the cue such that the straight sighting line runs parallel to a length of the cue and is visible to a user in use, and wherein the plane of the major portion of the sighting aid is either sunk into the profile of the cue or is in-line with the profile of the cue.

2. The cue system according to claim 1 wherein the straight sighting line extends for a majority or an entirety of a length of the sighting body and/or the sighting aid.

3. The cue system according to claim 1 wherein the straight sighting line is intercepted by a down-step.

4. The cue system according to claim 1 wherein the sighting aid is releasably attached to the cue.

5. The cue system of claim 1, wherein the straight sighting line is oriented to identify if there is an error in alignment of the cue toward a target.

6. A golf club comprising:

a shaft; and a golf club head system, wherein a portion of the golf club head system is connected to a distal end of the shaft, wherein the golf club head system comprises:

a golf club head presenting a ball-striking face;

a sighting aid comprising a sighting body having marked or formed thereon a straight sighting line extending longitudinally thereof, wherein the straight sighting line is intercepted by an up-step or down-step, wherein the sighting aid is integral with or attached to the golf club head, the sighting body comprising a stepped protrusion extending away from the ball-striking face in the direction in which a golf ball is to be played such that the straight sighting line runs parallel to and is located in-line with the ball-striking face of the golf club head and is visible to a user in use, wherein the ball-striking face is structured to strike a golf ball during normal play.

7. The golf club according to claim 6, the golf club head presenting a toe portion wherein the sighting aid is located proximal to the toe portion of the golf club head.

8. The golf club of claim 6, wherein the straight sighting line is oriented to identify if there is an error in alignment of the ball-striking face substantially perpendicular to a direction toward a target.

9. The golf club of claim 6, wherein the portion of the golf club head system is proximal to a heel portion of the golf club head.

10. A method of sighting a shot or stroke in a cue sport comprising:

providing a cue system, comprising:

a cue presenting a cue profile; and a sighting aid comprising a sighting body that includes a major portion and a minor portion, the sighting body having marked or formed thereon a straight sighting line extending longitudinally thereof, wherein the straight sighting line is intercepted by a sighting aid up-step or down-step presenting a vertical discontinuity along said sighting line in a plane formed between an upper surface of the major portion and an upper surface of the minor portion, said vertical discontinuity enabling visualization of parallax error, wherein the sighting aid is integral with or attached to the cue such that the straight sighting line runs parallel to a length of the cue and is visible to a user in use, and wherein the plane of the major portion of the sighting aid is either sunk into the profile of the cue or is in-line with the profile of the cue; and aligning the cue in a direction of a target.

11. The method of claim 10, wherein the aligning comprises using the straight sighting line to identify if there is an error in alignment of the cue toward the target, and if there is an error in alignment, adjusting the cue until there is no error in alignment toward the target.

12. A method of preparing for a shot in golf comprising:

providing a golf club comprising:

a shaft; and a golf club head system, wherein a portion of the golf club head system is connected to a distal end of the shaft, wherein the golf club head system comprises:

a golf club head presenting a ball-striking face; and a sighting aid comprising a sighting body having marked or formed thereon a straight sighting line extending longitudinally thereof, wherein the straight sighting line is intercepted by an up-step or down-step, wherein the sighting aid is integral with or attached to the golf club head, the sighting body comprising a stepped protrusion extending away from the ball-striking face in the direction in which a golf ball is to be played such that the straight sighting line runs parallel to and is located in-line with the ball-striking face of the golf club head and is visible to a user in use, wherein the ball-striking face is structured to strike a golf ball during normal play; and aligning the ball-striking face of the golf club head perpendicular to a direction of a target.

13. The method according to claim 12, the golf club head presenting a toe portion and wherein the sighting aid is located proximal to the toe portion of the golf club head.

14. The method of claim 12, wherein the aligning comprises using the straight sighting line to identify if there is an error in alignment of the ball-striking face substantially perpendicular to a direction toward the target, and if there is an error in alignment, adjusting the ball-striking face until there is no error in alignment of the ball-striking face substantially perpendicular to the direction toward the target.

15. The method of claim 12, wherein the portion of the golf club head system is proximal to the heel portion of the golf club head.

16. A golf club head system comprising:

a golf club head presenting a ball-striking face; and a sighting aid comprising a sighting body having marked or formed thereon a straight sighting line extending longitudinally thereof, wherein the straight sighting line is intercepted by an up-step or down-step, wherein the sighting aid is integral with or attached to the golf club head, the sighting body comprising a stepped protrusion extending away from the ball-striking face in the direction in which a golf ball is to be played such that the straight sighting line runs parallel to and is located in-line with the ball-striking face of the golf club head and is visible to a user in use, wherein the ball-striking face is structured to strike a golf ball during normal play.

17. The golf club head system according to claim 16 wherein the straight sighting line extends for a majority or an entirety of length of the sighting body and/or the sighting aid.

18. The golf club head system according to claim 16 wherein the straight sighting line is intercepted by a down-step.

19. The golf club head system according to claim 16 wherein the sighting aid is releasably attached to the golf club head.

20. The golf club head system according to claim 16, the golf head presenting a toe portion and wherein the sighting aid is located proximal to the toe portion of the golf club head.

21. The golf club head system of claim 16, wherein the straight sighting line is oriented to identify if there is an error in alignment of the ball-striking face substantially perpendicular to a direction toward a target.

* * * * *